United States Patent [19]

Pacitti

[11] Patent Number: 4,469,328

[45] Date of Patent: Sep. 4, 1984

[54] APPARATUS FOR RACKING BILLIARD BALLS

[76] Inventor: Thomas G. Pacitti, 220 Mountain St., Philadelphia, Pa. 19148

[21] Appl. No.: 479,166

[22] Filed: Mar. 28, 1983

[51] Int. Cl.[3] ..... A63D 15/00

[52] U.S. Cl. ..... 273/22

[58] Field of Search ..... 273/22

[56] References Cited

U.S. PATENT DOCUMENTS

| | | | |
|---|---|---|---|
| 10,801 | 1/1887 | Henkel | 273/22 |
| 501,256 | 7/1893 | Rohbach | 273/22 |
| 1,089,140 | 3/1914 | Madigan | 273/22 |
| 1,093,123 | 4/1914 | Goyette | 273/22 |
| 1,115,911 | 11/1914 | Dickerson | 273/22 |
| 3,992,005 | 11/1976 | Richey | 273/22 |

*Primary Examiner*—Richard C. Pinkham
*Assistant Examiner*—T. Brown
*Attorney, Agent, or Firm*—Sanford J. Piltch

[57] ABSTRACT

A racking device for one or more different billiard games wherein each of the games have a different placement of the balls at the outset. The device being substantially triangular is convertible to the starting configurations of each of the games by the hinged overlaying triangluar member moving rotationally about its hinge point. Additionally, the external surface of the device has indentations for the placement of billiard balls in a newly created game.

6 Claims, 6 Drawing Figures

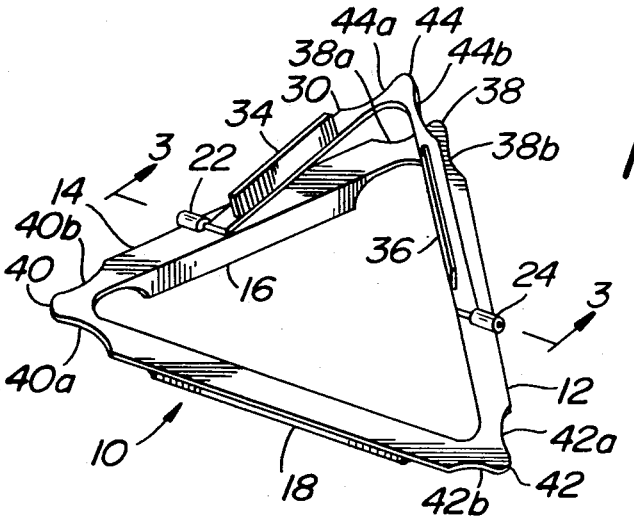
FIG. 1
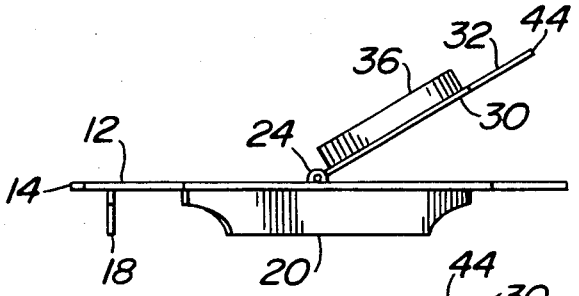
FIG. 2
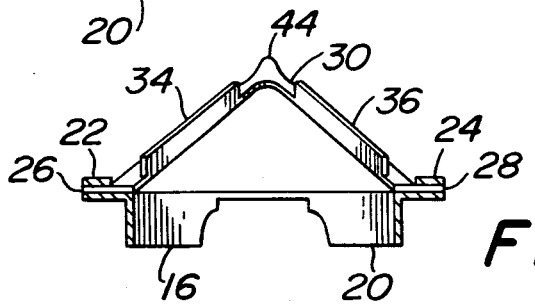
FIG. 3
FIG. 4
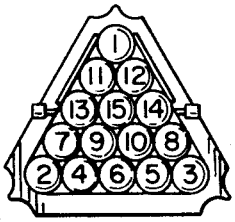
FIG. 5
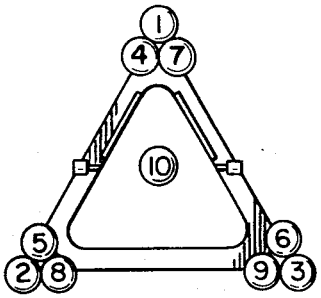
FIG. 6
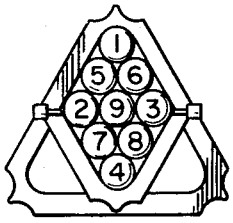

APPARATUS FOR RACKING BILLIARD BALLS

BACKGROUND OF THE INVENTION

This invention falls in the area of devices used for racking balls for various different games of billiards and/or pocket pool which have been played by many people over the years. For the most part the standard racking devices for billiard games were of triangular construction with smooth surfaces both inside and out with the exception of any ornamental or non-useful designs on the exterior surfaces of the racking device. These devices were substantially fixed in both shape and size and were not capable of being varied, in regard to their shape, in order to accommodate any change in the placement of the balls for different games which could be played on the same table.

It is, therefore, an object of the present invention to provide a racking device capable of being varied so as to accommodate the placement of the balls in different locations about the rack dependent upon the game to be played.

It is another object of the present invention to provide a single racking device capable of accommodating the placement of the balls for more than one standard game without the necessity of substituting a second racking device of differing dimensions to insure proper ball placement for a non-standard billiard game.

Other objects will appear hereinafter.

SUMMARY OF THE INVENTION

The apparatus of the present invention provides for the use of a single racking device for one or more different billiard games having distinctly different ball placements at the outset of each game. The racking device is configured in a substantially equilateral triangular configuration as in the previously-known billiard ball racking devices. The present ball racking device also provides an overlaid triangular member hinged to the underlying triangular ball rack along two adjacent sides at equidistant points, the overlaid triangular member having a rotational movement about said hinges for converting the area within the rack in which the balls are placed to a smaller area having a different configuration for a different game. Additionally, the external surface of the rack of the present invention has certain elliptical indentations at each apex of the device for locating or placing the billiard balls for a newly-created game. Thus a single racking device becomes capable of being converted and used for several different billiard games without the need for exchanging on racking device for another.

The present invention is for use in racking balls for one or more different billiard games and comprises a substantially equilateral triangular member with elliptical indentations at each of its apices having a hinge located one-half the distance from an apex along adjacent sides of the triangular member for supporting a bilateral member adaptable for rotational movement about the hinges. The bilateral member is movable from a first position overlying the apex of the triangular member in substantial parallel relation thereto to a second position where the apex of the bilateral member is supported by the nonadjacent side of the triangular member. While in such supported position, the bilateral member is also in substantial parallel relation to the triangular member. The elliptical indentations at each of the apices of the equilateral triangular member are of a sufficient depth to accommodate one-quarter of the surface circumference of a billiard ball in touching relation thereto. The equilateral triangular member is supported to an approximate height equal to one-half the diameter of a billiard ball and has a flange extending outward from it adapted to retain the billiard balls at its apices. The bilateral member likewise has a flange for retaining the billiard balls within an acute angle in either its first or its second position and, when in its first position, substantially conforms to the shape of the equilateral triangular member.

BRIEF DESCRIPTION OF THE DRAWINGS

For the purposes of illustrating this invention, there are shown in the drawings forms which are presently preferred; it being understood, however, that the invention is not limited to the precise arrangements and instrumentality shown.

FIG. 1 is a prospective view of the apparatus of the present invention.

FIG. 2 is a side view of the apparatus of the present invention.

FIG. 3 is a sectional view of the apparatus of the present invention taken along Line 3—3 of FIG. 1.

FIG. 4 is a diagram showing the placement or arrangement of billiard balls for the straight game of pool.

FIG. 5 shows the placement or arrangement of billiard balls for the 10-ball game of pool.

FIG. 6 shows the placement or arrangement of billiard balls for the 9-ball game of pool.

DETAILED DESCRIPTION OF THE PREFERRED EMBODIMENT OF THE INVENTION

The following detailed description is of the best presently contemplated mode of carrying out the present invention. This description is not intended in a limiting sense, but is made solely for the purpose of illudstrating the general principles of the invention. Referring to FIG. 1, there is shown a ball rack 10 of the present invention having a frame 12 formed with equilateral sides. The rack 10 of the present invention conforms in size, with specific regard to the lengths of its sides and its height, to the dimensions set out in the several recognized pocket billiards association throughout the world. The frame 12 has a flange 14 along each of its sides at a height of one-half the diameter of the balls used for the games and is supported by support members 16, 18, and 20 along the underside of each of its three sides. These support members 16, 18, and 20 extend along the internal edge of the flange 14 on each of the sides and is preferred to truncate a fixed distance away from each of the apices of the frame 12 in any manner presently known so as not to interfere with the placement of the balls at or near the apices of the frame 12.

Along the flange 14 over the support members 16 and 20 and equidistant from the apices of the frame 12, hinges 22 and 24 are located over support members 16 and 20 respectively. These hinges 22 and 24 secure a movable frame 30 to the frame 12 by means of pins 26 and 28 permanently fastened to the movable frame 30. The pins 26 and 28 fit within the hinges 22 and 24 snugly but with sufficient freedom of movement of allow the movable frame to rotate from a position parallel to and resting on the flange 14 of the frame 12 overlying apex 38 to a position overlying flange 14 as supported by support member 18 as described more fully hereinafter.

The movable frame 30 has a flange 32 which has support members 34 and 36 dimensioned similarly to the previously-described support members 16, 18, and 20. The support members 34 and 36 are preferred to be of a length which provides for sufficient clearance of the flange 14 overlying support member 18 when the movable frame 30 is moved from its first position to its second position.

The movable frame 30 overlies apex 38 in a parallel adjacent manner in its first position. By parallel it is meant that the flanges 32 and 14 are in parallel relationship to each other and are preferred to be in touching relationship to each other. The movable frame 30 is rotatable about the hinges 22 and 24 a full 180°, In the second position the support members 34 and 36 provide additional support for the flange 32 of the movable frame 30 as its apex 44 overlies and is supported by the midpoint of the flange 14 of the frame 12 supported by support member 18. It is preferred that the support members 34 and 36 are dimensioned so that, in its second position, the underside of the apex 44 of movable frame 30 is in touching relation to the support surface of flange 14. It should be noted that, in its first position, movable frame 30 has its apex 44 exactly overlying apex 38 of the frame 12.

Each of the apices 38–44 have elliptical indentations a and b. Each of these elliptical indentations is capable of receiving in touching relation thereto approximately one-quarter of the surface circumference of a billiard ball placed at each of the respective apices of the rack 10. The apex 44 of movable frame 30 when in its first position has an identical configuration to that of the apex 38 of frame 12 and can similarly accommodate the billiard balls within its elliptical indentation.

The rack 10 of the present invention is capable of being used for a game of straight pool as is shown in FIG. 4. In this configuration all 15 of the billiard balls are placed within the ball rack with the movable frame 30 in its first position, having its apex 44 overlying the apex 38 of frame 12. In FIG. 5, the rack 10 is centered on the foot spot with the 10 ball located thereon. At each of its apices 38, 40, and 42, three balls are placed in a triangular configuration in touching relation to each of the other balls and the elliptical indentations of the respective apices. The balls so located are numbered 1 through 9 with the balls numbered 1, 4, and 7 placed at one apex, the balls numbered 2, 5, and 8 placed at a second apex, and the balls numbered 3, 6, and 9 placed at the remaining apex of the rack 10. This is a configuration for a new game of pocket billiards called 10-ball for which the rules will be described shortly. FIG. 6 shows the movable frame 30 in its second position overlying the flange 14 over support member 18 for a new configuration for the pocket billiards game called 9-ball. Instead of the usual triangular configuration for 9-ball, the rack of the present invention provides for a diamond configuration providing a higher difficulty fctor in the break shot than with the normal configuration.

The new game of pocket billiards called 10-ball begins with the set-up of the balls 1 through 10 in a configuration shown in FIG. 5 and described above. The balls may be either hand-frozen or tapped into position. It is the object of the game of 10-ball to remove in rotation, by calling the ball and pocket, each ball with the exception that no selection of ball or pocket need be made on the break shot. The breaker, in order to make a legal shot, must hit the 1 ball with the cue ball and the cue ball and/or any other ball must hit a cushion with the exception of the 10 ball. If any ball on the break shot moves or touches the 10 ball, the shooter loses. When a legal break shot is made, any ball that is pocketed remains so. The shooter continues his turn until be misses or scratches.

When the breaker does not make a legal shot, his opponent may ask the referee for a re-rack or to give the shooter a scratch. If the opponent elects to give the shooter a scratch, then he, as the incoming shooter, must play the table as it stands. It should be noted that, in this game of 10-ball, there is no ball in hand rule. Any player making three scratches in a row loses.

The playing sequence for the game of 10-ball is in rotation. This is to say that the balls numbered 1 through 9 must be pocketed before attempting to pocket the 10 ball. However, a player may try to pocket the 10 ball by trying a combo or kiss-off shot using any of the other balls. If he misses pocketing the 10 ball, the shooter loses.

When a player sinks the cue ball and the object ball is behind the head string line, it remains. The incoming player must play the object ball by hitting the side rails or foot rail. If the shooter fails to hit the object ball, his opponent can request him to repeat his shot even for a third try and, if all three shots fail, the shooter loses.

Upon sinking the last of the balls numbered 1 through 9 and the shooter scratches, all balls stay pocketed. The opponent then has a spot for the 10 ball. If he misses pocketing the 10 ball, play will continue until one or the other of the players pockets the 10 ball. If the cue ball is pocketed while only the 10 ball remains on the table, the shooter loses. Safe shots are allowed when the cue ball strikes the object ball and either of the balls hits a cushion.

The present invention provides a single apparatus for use in racking billiard balls for several different games while capable of modification to accommodate the different configurations of the placement of balls at the outset of the games. This is instead of requiring several racks, i.e., one for each of the different games.

The present invention also permits players to achieve a different starting position for the billiard balls in the game of 9-ball. The diamond shape provides the shooter with a different than normal configuration which changes the strategy of play from the outset. This new configuration should provide a challenge to those players using this configuration of the present invention.

The present invention may be embodied in other specific forms without departing from the spirit or the essential attributes thereof and, accordingly, reference should be made to the appended claims rather than to the specification as indicating the scope of the invention.

I claim:

1. Apparatus for use in racking balls for one or more different billiard games comprising a substantially equilateral triangular member with elliptical indentations in the external surface and at each of its apices having a hinge located one half the distance from an apex along adjacent sides of the triangular member for supporting a bilateral member adaptable for rotational movement about the hinges, said bilateral member being movable from a first position overlying the apex of the triangular member in substantial parallel relation thereto to a second position where the apex of the bilateral member is supported by the non-adjacent side of the triangular member also in substantial parallel relation thereto.

2. Apparatus as in claim 1 wherein said elliptical indentations are of a sufficient depth to accommodate one quarter of the surface circumference of a billiard ball in touching relation thereto.

3. Apparatus as in claim 1 wherein said triangular member is supported by a flange to a height equal to one half the diameter of a billiard ball.

4. Apparatus as in claim 1 wherein said bilateral member, when in its first position, conforms to the shape of the tirangular member.

5. Apparatus as in claim 1 wherein said bilateral member, when in its second position, creates a substantially diamond-shaped space within which to retain billiard balls.

6. Apparatus as in claim 1 wherein said bilateral member has a flange for retaining billiard balls within its acute angle when in its second position.

* * * * *